US006890245B1

(12) United States Patent
Kistler

(10) Patent No.: US 6,890,245 B1
(45) Date of Patent: May 10, 2005

(54) BYPRODUCT CONTROL IN LINEAR CHEMICAL MECHANICAL PLANARIZATION SYSTEM

(75) Inventor: Rodney C. Kistler, Los Gatos, CA (US)

(73) Assignee: Lam Research Corporation, Fremont, CA (US)

( * ) Notice: Subject to any disclaimer, the term of this patent is extended or adjusted under 35 U.S.C. 154(b) by 136 days.

(21) Appl. No.: 10/132,096

(22) Filed: Apr. 24, 2002

(51) Int. Cl.[7] ..... B24B 1/00
(52) U.S. Cl. ..... 451/56; 451/444
(58) Field of Search ..... 451/56, 443, 444, 451/60, 296, 446, 41

(56) References Cited

U.S. PATENT DOCUMENTS 6,186,865 B1 * 2/2001 Thornton et al. ..... 451/8
6,350,183 B2 * 2/2002 Manfredi ..... 451/56
6,443,816 B2 * 9/2002 Inoue et al. ..... 451/56
6,468,134 B1 * 10/2002 Gotkis ..... 451/36

* cited by examiner

*Primary Examiner*—Dung Van Nguyen
(74) *Attorney, Agent, or Firm*—Martine Penilla & Gencarella, LLP

(57) ABSTRACT

In a method for controlling byproduct build-up on a polishing pad, a chemistry is introduced onto the top surface of the polishing pad in the presence of a source of kinetic energy. When the source of kinetic energy is a pressurized gas, the chemistry is sprayed onto the top surface of the polishing pad. When the source of kinetic energy is a brush that applies a force against the top surface of the polishing pad, the brush is used to brush the top surface of the polishing pad while applying the chemistry onto the top surface of the polishing pad through the brush. A CMP system for implementing this method includes one or both of a mixing manifold and a brush.

4 Claims, 7 Drawing Sheets

Fig. 1D
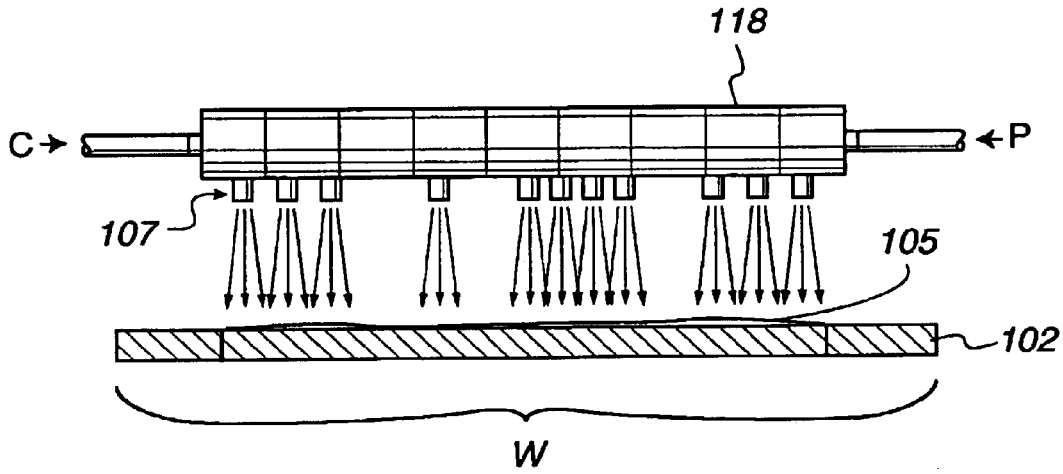
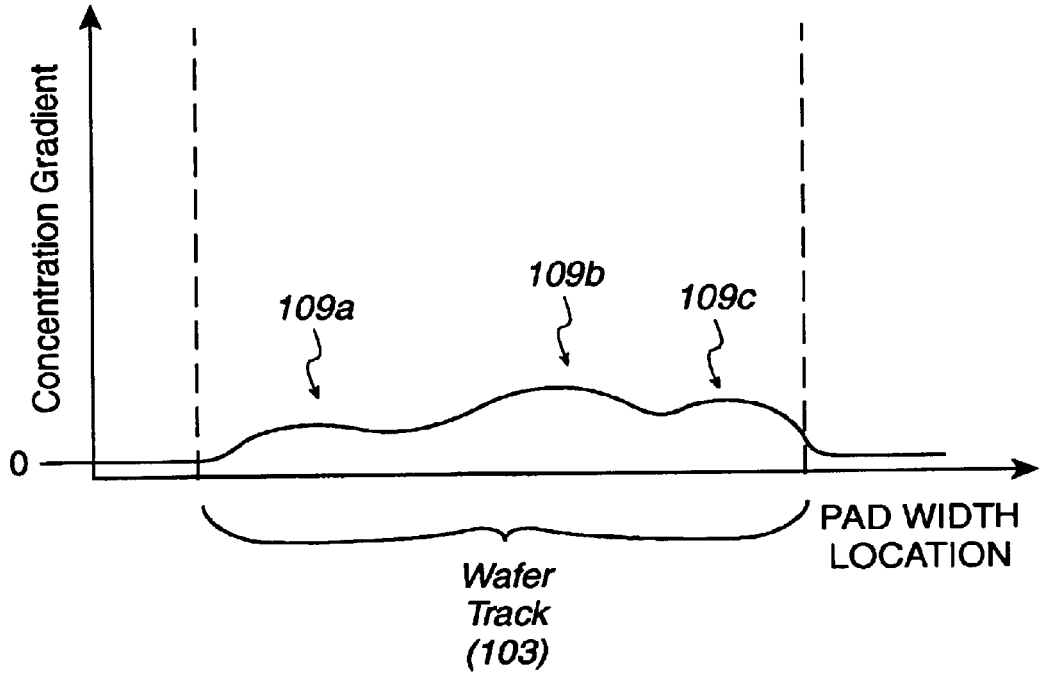
Fig. 1E

BYPRODUCT CONTROL IN LINEAR CHEMICAL MECHANICAL PLANARIZATION SYSTEM

BACKGROUND OF THE INVENTION

The present invention relates generally to semiconductor fabrication and, more particularly, to a system and method for controlling byproduct build-up on a polishing pad in, e.g., a linear chemical mechanical planarization (CMP) system.

In the fabrication of semiconductor devices, CMP is used to planarize globally the surface of an entire semiconductor wafer. CMP is often used to planarize dielectric layers as well as metallization layers. As is well known to those skilled in the art, metallization layers are formed of conducting metals, e.g., aluminum and copper. During the CMP of copper films, $Cu_xO_y$ byproducts are formed and the surface of the polishing pad absorbs these byproducts. The build-up of $Cu_xO_y$ byproducts on the pad surface increases with each passing wafer. This is problematic because these byproducts introduce additional abrasivity into the CMP process. The additional abrasivity introduced by the $Cu_xO_y$ byproducts is undesirable because it affects removal rate uniformity and leads to process instability and lack of control. In addition, byproduct build-up in the grooves formed in the pad can impede slurry transport. When slurry transport is impeded, control of the within-wafer nonuniformity and the removal across the wafer may be lost.

To ensure wafer-to-wafer process repeatability and control, the build-up of $Cu_xO_y$ byproducts should be removed from the polishing pad. One way to remove these byproducts is to introduce and distribute an appropriate chemistry across the pad surface. The chemistry will react with the $Cu_xO_y$ byproducts and convert or complex them into ionic form so that they can be rinsed from the surface of the polishing pad. In the past, chemistries have been dripped onto the surface of the polishing pad. This technique suffers from two potential drawbacks, however. First, the overall process productivity may be adversely impacted because of the time interval required to remove thoroughly all of the byproduct materials. Second, prolonged exposure to the chemistry can compromise the passivation film that protects the low-lying regions of copper. If this passivation film is compromised, then wet etching can occur in the low-lying regions of copper. Such wet etching is undesirable because it causes the planarization efficiency of the process to fall off significantly and leads to increased dishing and erosion problems.

In view of the foregoing, there is a need for a method that efficiently removes byproduct build-up from a polishing pad in a linear CMP system without adversely impacting the overall process productivity or the planarization efficiency.

SUMMARY OF THE INVENTION

Broadly speaking, the present invention fills this need by providing a method for controlling byproduct build-up on a polishing pad in which a chemistry is introduced onto the top surface of the polishing pad in the presence of a source of kinetic energy. The present invention also provides a chemical mechanical planarization (CMP) system configured to implement the method for controlling byproduct build-up on a polishing pad.

In accordance with one aspect of the present invention, a method for controlling byproduct build-up on a polishing pad in a linear CMP system is provided. In this method, a chemistry is introduced onto a top surface of a polishing pad in the presence of a source of kinetic energy. In one embodiment, the source of kinetic energy is a pressurized gas, and the chemistry is sprayed onto the top surface of the polishing pad. In one embodiment, the chemistry is sprayed onto the top surface of the polishing pad at a top zone of the polishing pad. In one embodiment, the spray of chemistry is configured to match a concentration gradient across a wafer track defined on the polishing pad.

In another embodiment, the source of kinetic energy is a brush that applies a force against the top surface of the polishing pad, and the brush is used to brush the top surface of the polishing pad while applying the chemistry onto the top surface of the polishing pad through the brush. In one embodiment, the brush contacts the top surface of the polishing pad at a bottom zone of the polishing pad. In one embodiment, the brush is a polyvinyl alcohol brush.

In accordance with another aspect of the present invention, a method for removing byproduct build-up from sidewalls of grooves defined in a polishing pad in a linear chemical mechanical planarization system is provided. In this method, a chemistry is sprayed onto a top surface of a polishing pad at a top zone of the polishing pad. The top surface of the polishing pad also is brushed at a bottom zone of the polishing pad while applying a chemistry onto the top surface of the polishing pad through the brush. In one embodiment, the brush applies a force against the top surface of the polishing pad sufficient to accelerate removal of byproduct build-up on sidewalls of grooves defined in the polishing pad.

In accordance with yet another aspect of the present invention, a CMP system is provided. The CMP system includes a pair of drums that are configured to rotate. A polishing pad is disposed around the pair of drums. A polishing head, which is configured to hold a semiconductor wafer, is disposed above a top surface of the polishing pad. The CMP system also includes a slurry dispenser for dispensing a slurry onto the top surface of the polishing pad. In one embodiment, the CMP system further includes a mixing manifold having a plurality of outlets configured to direct a pressurized spray of a chemistry onto a top surface of the polishing pad. The mixing manifold is configured to be coupled in flow communication with a chemical source and a source of pressurized gas. In addition, the mixing manifold is disposed on the side of the polishing head that is opposite of the side on which the slurry dispenser is disposed. In one embodiment, the plurality of outlets is configured to match a concentration gradient across a wafer track defined on the polishing pad. In one embodiment, the plurality of outlets is configured to direct the pressurized spray of the chemistry onto the top surface of the polishing pad at a top zone of the polishing pad.

In another embodiment, the CMP system further includes a brush for brushing the top surface of the polishing pad at a bottom zone of the polishing pad. The brush is configured to apply a chemistry onto the top surface of the polishing pad through the brush. In addition, the brush is rotatably disposed against the top surface of the polishing pad. In one embodiment, the brush is a polyvinyl alcohol brush. In one embodiment, the force the brush applies against the top surface of the polishing pad is sufficient to accelerate removal of byproducts that have built-up on the top surface of the polishing pad. In one embodiment, the brush is adjustably supported so that the force the brush applies against the top surface of the polishing pad can be adjusted.

In a further embodiment, the CMP system includes a mixing manifold and a brush. The mixing manifold has a plurality of outlets configured to direct a pressurized spray of a chemistry onto a top surface of the polishing pad at a top zone of the polishing pad. The brush is used to brush the top surface of the polishing pad at a bottom zone of the polishing pad, and is configured to apply a chemistry onto the top surface of the polishing pad through the brush. Alternatively, the mixing manifold can be configured to direct a pressurized spray of chemistry onto the top surface of the polishing pad at the bottom zone thereof, and the brush can be used to brush the top surface of the polishing pad at the top zone thereof.

In one embodiment, the CMP system includes a shroud for collecting back spray from the top surface of the polishing pad and redirecting such back spray back onto the top surface of the polishing pad, with the shroud being disposed proximate to the mixing manifold. In one embodiment, the shroud includes a pair of deflector plates. In one embodiment, the CMP system includes a collection shield that surrounds either the mixing manifold or the brush, depending upon which of these components is configured to clean the polishing pad at the bottom zone thereof. When the collection shield surrounds the mixing manifold, the collection shield collects back spray from the top surface of the polishing pad. When the collection shield surrounds the brush, the collection shield collects chemistry and particulates that fall from the top surface of the polishing pad due to the brushing action.

The introduction of a chemistry onto to the top surface of a polishing pad in the presence of kinetic energy accelerates the removal of byproduct build-up from the surface of the polishing pad. This advantageously enables byproduct build-up to be removed from the polishing pad in a linear CMP system without adversely impacting the overall process productivity or the planarization efficiency.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

FIG. 1D is a simplified schematic diagram that shows a mixing manifold having a plurality of outlets configured to match the concentration gradient across a wafer track in accordance with one embodiment of the invention.

FIG. 1E is a graph of concentration gradient versus pad width location that illustrates how the concentration gradient of byproduct build-up can vary across the wafer track.

DETAILED DESCRIPTION OF THE INVENTION

Several exemplary embodiments of the invention will now be described in detail with reference to the accompanying drawings.

The present invention provides a system and method for controlling byproduct build-up on a polishing pad in a linear chemical mechanical planarization (CMP) system. As used in connection with the description of the invention, the terms "byproduct" and "byproduct residues" refer to any material that is generated during or remains after a semiconductor wafer is subjected to a CMP operation.

Figure 1A:
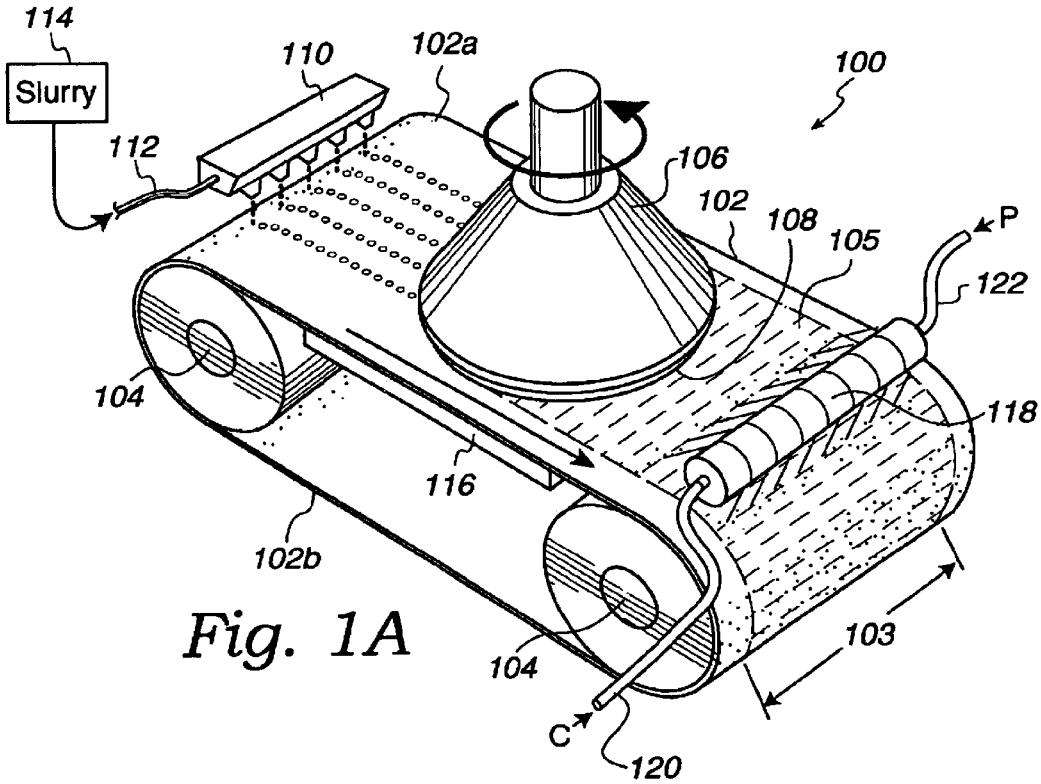
FIG. 1A is a simplified perspective view of a linear chemical mechanical planarization (CMP) system including a mixing manifold for spraying a chemistry onto the top surface of the polishing pad in accordance with one embodiment of the invention.

FIG. 1A is a simplified perspective view of linear CMP system 100 in accordance with one embodiment of the invention. As shown therein, CMP system 100 includes polishing pad 102, which is in the form of a belt that is disposed around rotating drums 104. Top zone 102*a* of polishing pad 102 includes the portion of the polishing pad that is disposed above the horizontal centerline of drums 104. Bottom zone 102*b* of polishing pad 102 includes the portion of the polishing pad that is disposed below the horizontal centerline of drums 104. Polishing head 106 is disposed above the top surface of polishing pad 102 and is configured to hold semiconductor wafer 108 in place during processing. Slurry dispenser 110 dispenses slurry onto the top surface of polishing pad 102. In one embodiment, slurry dispenser 110 is a slurry manifold (sometimes referred to as a slurry bar) that is configured to dispense slurry across the top surface of polishing pad 102. Slurry is delivered to slurry dispenser 110 via supply conduit 112, which is in flow communication with a source 114 of slurry.

As polishing pad 102 moves (e.g., in the direction of the straight arrow shown in FIG. 1A), polishing head 106 rotates (e.g., in the direction of the curved arrow shown in FIG. 1A) and lowers wafer 108 onto the top surface of the polishing pad. Platen assembly 116 supports polishing pad 102 during the CMP operation. Those skilled in the art are familiar with the details and operation of linear CMP systems. By way of example, the foregoing components, i.e., polishing pad 102, drums 104, polishing head 106, slurry dispenser 110, and platen assembly 116 may be the same as used in the TERES™ CMP system, which is commercially available from Lam Research Corporation of Fremont, Calif. (the assignee of this application).

With continuing reference to FIG. 1A, mixing manifold 118 is disposed above the top surface of polishing pad 102 on the side of polishing head 106 that is opposite of the side on which slurry dispenser 110 is disposed. Mixing manifold 118 is coupled to conduits 120 and 122. Conduit 120 is coupled in flow communication with an aqueous chemical source, as indicated by the arrow labeled C in FIG. 1A. Conduit 122 is coupled in flow communication with a source of pressurized gas, e.g., nitrogen, as indicated by the arrow labeled P in FIG. 1A. The pressure of the pressurized gas should be sufficient to generate a spray of chemistry that accelerates the removal of byproducts that have built-up on the top surface of the polishing pad relative to the removal of byproducts obtained by dripping the chemistry onto the surface of the polishing pad. In one embodiment, the pressurized gas is at a pressure in the range from 1 psi to 100 psi.

In copper CMP, the $Cu_xO_y$ byproducts can be removed using suitable chelating chemistries. By way of example, suitable chemistries include citric acid, ammonia-containing chemistries, e.g., ammonium hydroxide-containing chemistries and ammonium citrate-containing chemistries, and HCl. More specific details regarding a variety of chemistries that are suitable for use in removing $Cu_xO_y$ byproducts from a polishing pad are disclosed in commonly owned U.S. Pat. No. 6,352,595 B1, the disclosure of which is incorporated herein by reference. Post-CMP cleaning chemistries formulated to remove residual copper in cleaning applications also may be used. Examples of post-CMP cleaning chemistries are disclosed in commonly owned U.S. Pat. No. 6,165,956 and commonly owned U.S. application Ser. No. 09/037,586, filed on Mar. 9, 1998, the disclosures of which are incorporated herein by reference.

Continuing with reference to FIG. 1A, the polishing pad 102 rotates around the drums 104 with the polishing pad 102 having a top surface that acts as the active surface during the planarization operation. In connection with the description of the invention, the top surface of the polishing pad 102 that is being subjected to agitation by the polishing head 106 and wafer 108 will be referred to as the top zone 102*a* of the polishing pad. As the polishing pad 102 rotates around the drums 104, that same top surface will then be positioned opposite to the end of the polishing head 106, i.e., at the bottom plane defined by the polishing pad. This location will be referred to herein as the bottom zone 102*b* of the polishing pad.

As the polishing head 106 lowers the wafer 108 for a polishing operation, the polishing pad 102 will begin to get filled with polish byproduct residues from the wafer being polished. These residues are shown on the polishing pad 102 along a wafer track 103 that is approximately defined as the width of the wafer 108 being polished. For instance, if the wafer being polished is a wafer having a top surface that is predominantly oxide, the polishing pad 102 will start to exhibit a concentration gradient 105 composed of byproduct residues from the polishing operation. The concentration gradient 105 will not always be even across the wafer track 103.

To combat the non-uniform distribution of the concentration gradient 105 in the wafer track 103, the mixing manifold 118 includes a plurality of outlets, e.g., spray nozzles, that can be directionally applied to specific portions of the polishing pad 102 along the wafer track 103. This specific application of the aqueous chemical solution C and the source of pressurized gas P through the mixing manifold 118 will be discussed in greater detail below with reference to FIGS. 1D and 1E.

Figure 1B:
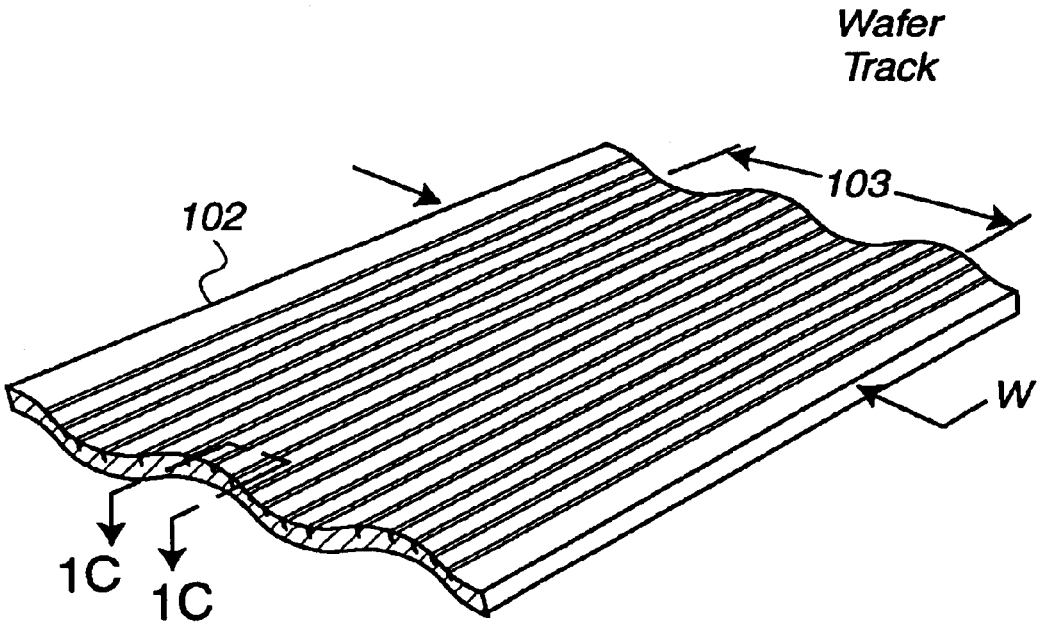
FIG. 1B is a simplified partial perspective view of a polishing pad that shows the wafer track defined on the surface of the polishing pad.
Figure 1C:
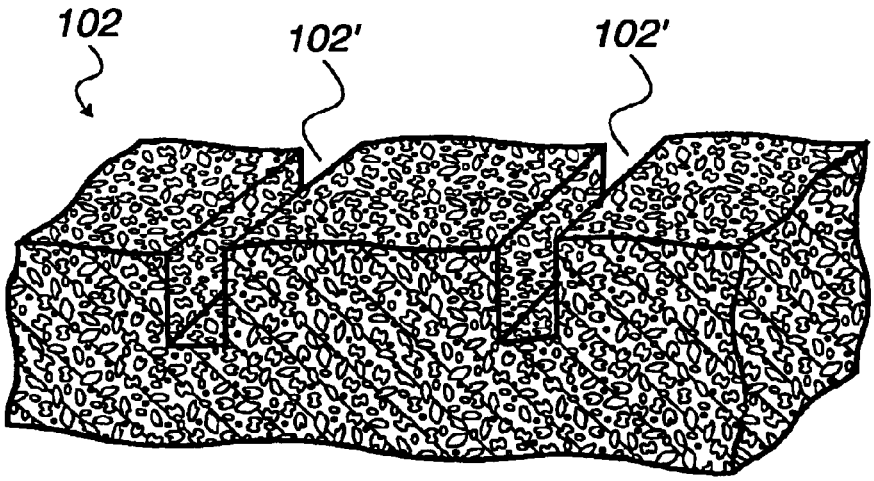
FIG. 1C is an enlarged cross-sectional view of the polishing pad taken along section 1C—1C shown in FIG. 1B that shows the grooves formed in the polishing pad.

FIG. 1B shows a three-dimensional perspective view of the polishing pad 102 and the top pad surface. As shown, the pad surface includes a plurality of grooves 102' as shown in FIG. 1C. The grooves are designed to assist in transporting the flow of slurry to the wafer and transporting polish byproduct residues away from the wafer during a CMP operation. As shown, the width, W, of the polishing pad 102 will be distributed with a plurality of grooves 102'. In the grooved area, the wafer track 103 is defined, and is generally defined by the width of the wafer being prepared. That is, if the wafer is a 200 mm wafer, the wafer track 103 will be smaller than if it were a 300 mm wafer. FIG. 1C illustrates how the surface of the polishing pad 102 includes a plurality of microscopic pores, which are used to facilitate the distribution of the slurry material as well as the resulting polishing operation on a particular wafer surface.

FIG. 1D shows a cross-sectional view of the mixing manifold 118 having a plurality of outlets 107. In one embodiment, the outlets are spray nozzles. The plurality of outlets 107 is directed toward the surface of the polishing pad 102. The outlets 107 can be designed to apply different pressures and distributions toward the surface of the polishing pad 102, depending upon the known or discovered concentration gradient 105 of byproduct build-up on the polishing pad 102. In one embodiment, each of the outlets 107 can be individually directed at different portions of the surface of the polishing pad 102. In still another embodiment, each outlet can be adjusted so as to apply a different spray force, and thus a different kinetic energy level, against the surface of the polishing pad 102. In the illustrated example, each of the outlets 107 has been strategically placed or aligned in the mixing manifold 118 so as to apply different levels of kinetic energy by way of the spray onto the residues that form the concentration gradient 105 on the surface of the polishing pad 102.

FIG. 1E shows a plotted diagram of an exemplary concentration gradient of byproduct build-up across the wafer track 103. In this example, the concentration of byproduct build-up is larger at point 109*b* than at points 109*a* and 109*c*. Accordingly, the mixing manifold 118 was adjusted so as to include a larger number of outlets 107 over the point 109*b* where the greater concentration of byproduct build-up occurs. Accordingly, any number of outlets may be applied to the mixing manifold 118, and the mixing manifold 118 may be specifically designed to be adjustable so as to enable adjustment depending upon the CMP process being performed, and the known, analyzed, or discovered concentration gradient of byproduct build-up being left on the surface of the polishing pad 102.

In still another embodiment, the mixing manifold 118 may be replaced altogether with another mixing manifold having a different distribution of outlets 107 for different applications. For instance, a specific mixing manifold 118 can be implemented for processes in which the wafer surface being polished is predominantly copper. In yet another embodiment, the mixing manifold 118 can be designed or selected for those cases in which the CMP operation is for removing oxide.

Figure 1F:
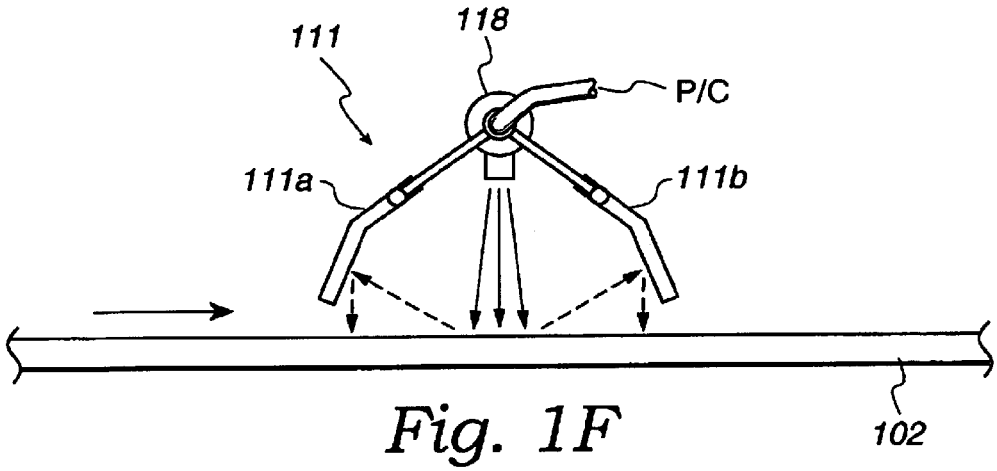
FIG. 1F is a simplified side view of the mixing manifold provided with a shroud to collect back spray from the surface of the polishing pad due to the pressurized spray in accordance with one embodiment of the invention.

FIG. 1F is a simplified side view of mixing manifold 118 provided with a shroud to collect back spray from the surface of the polishing pad due to the pressurized spray in accordance with one embodiment of the invention. As shown in FIG. 1F, shroud 111 includes deflector plates 111*a* and 111*b*, each of which is adjustably disposed at an angle above the top surface of polishing pad 102. Additional details regarding the adjustability of the deflector plates are set forth below with reference to FIG. 1G. Each of deflector plates 111*a* and 111*b* is configured to collect back spray from the surface of polishing pad 102 and redirect such back spray back onto the surface of the polishing pad. Deflector plates 11*a* and 111*b* may be formed of any suitable material, e.g., polyethylene terephthalate (PET). As shown in FIG. 1F, each of deflector plates 111*a* and 111*b* is bent at an angle. It will be apparent to those skilled in the art, however, that the deflector plates may have other suitable configurations, e.g., a curved configuration. It will be further apparent to those skilled in the art that the shroud may be implemented in a form different from that shown in FIG. 1F. By way of example, the shroud may be implemented as a one-piece component or as a multiple-piece component.

Figure 1G:
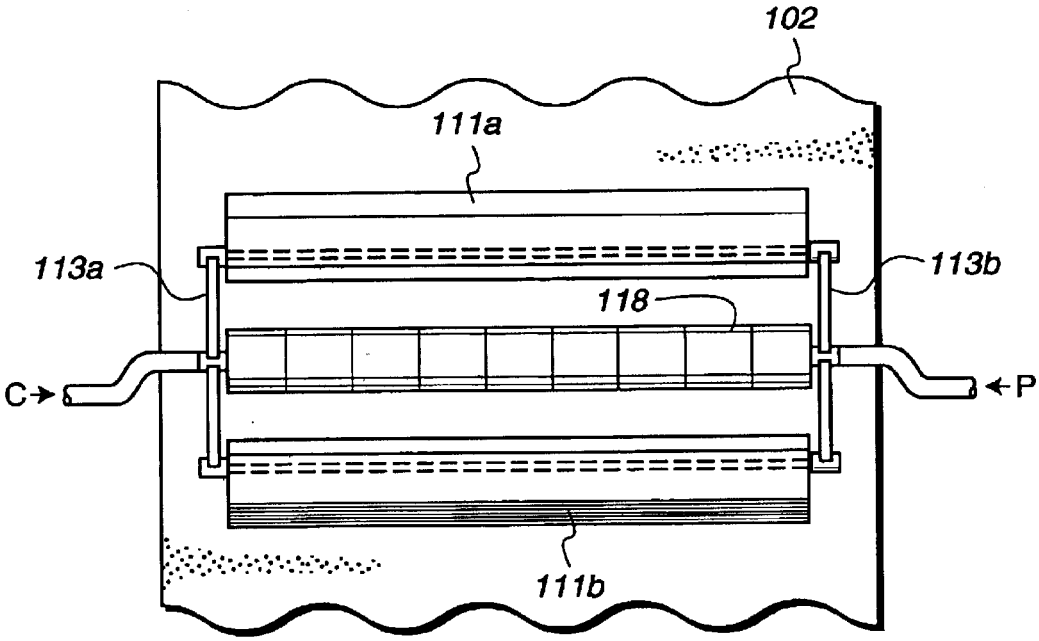
FIG. 1G is a simplified top plan view of the mixing manifold shown in FIG. 1F.

FIG. 1G is a simplified top plan view of mixing manifold 118 shown in FIG. 1F. As shown in FIG. 1G, each of deflector plates 111*a* and 111*b* is adjustably mounted between support rods 113*a* and 113*b*. In one embodiment, each of deflector plates 111*a* and 111*b* is pivotably mounted between support rods 113*a* and 113*b*. By appropriately adjusting the position of deflector plates 111*a* and 111*b*, the back spray from the surface of polishing pad 102 due to the pressurized flow can be collected and redirected back onto the surface of the polishing pad during a CMP operation.

Figure 2:
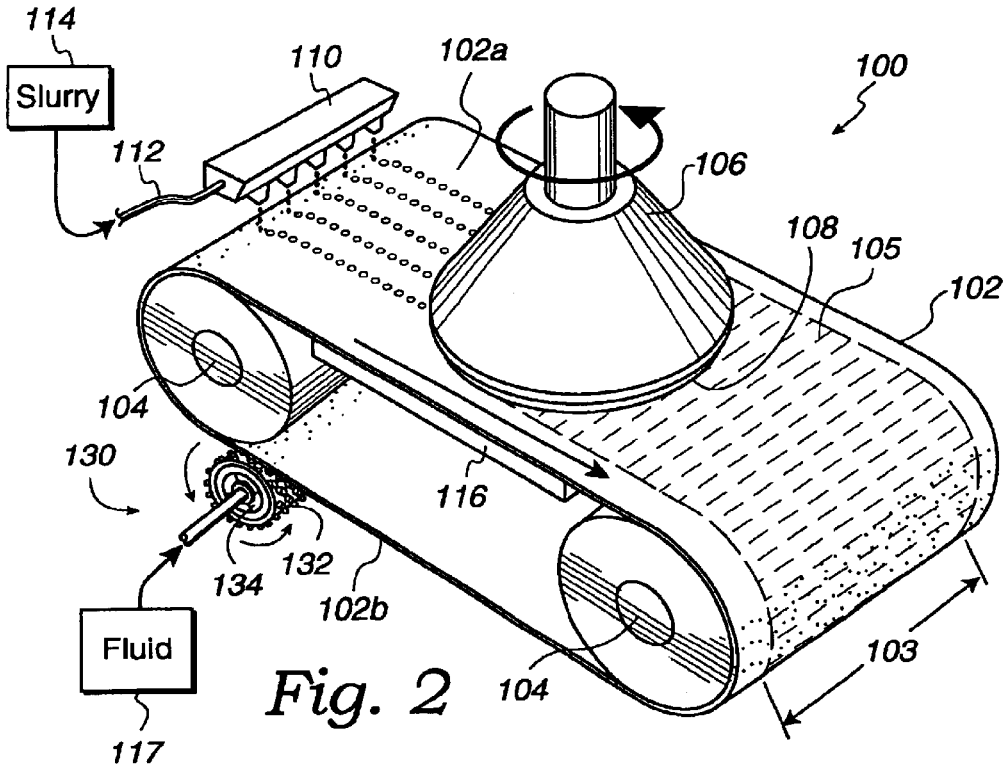
FIG. 2 is a simplified perspective view of a linear CMP system including a brush for brushing the top surface of the polishing pad while applying a chemistry onto the top surface of the polishing pad through the brush in accordance with one embodiment of the invention.

FIG. 2 is a simplified perspective view of a linear CMP system including a brush for brushing the top surface of the polishing pad while applying a chemistry onto the top surface of the polishing pad through the brush in accordance with one embodiment of the invention. In this embodiment, the linear CMP system 100 will omit the mixing manifold 118 and include a brush system 130 to assist in the byproduct removal or conditioning of the polishing pad 102. As shown in FIG. 2, the brush system 130 includes a brush 132, which is preferably a polyvinyl alcohol (PVA) brush that is mounted on a brush core 134. The brush core is preferably a hollow core that allows the introduction of a fluid and the delivery of a chemical through the brush, and onto the surface of the polishing pad 102. If desired, a collection shield may be provided to collect the chemical solution and any particulates that fall from the surface of the polishing pad 102. Additional details regarding the collection shield are set forth below with reference to FIG. 6.

In this preferred embodiment, the brush system 130 does not include a drive and, consequently, the movement of polishing pad 102 causes the brush 132 to rotate. As shown in FIG. 2, polishing pad 102 rotates in a clockwise manner and, consequently, the brush 132 will rotate in a counter-clockwise manner. By controlling the force the brush 132 applies against the surface of the polishing pad 102, the brush can be effectively applied to the surface of the polishing pad with a particular force designed to remove, clean, or dislodge byproducts left on the pad in the wafer track. If desired, the brush system 130 can be provided with a drive so that the brush 132 can be rotated in a clockwise manner, i.e., against the direction in which polishing pad 102 moves in the bottom zone 102*b* where the brush contacts the polishing pad. In a preferred embodiment, the fluids applied through the brush can be any suitable chemistry that will assist in dislodging, cleaning, or scrubbing the surface of the polishing pad 102.

The specific chemistry is selected depending upon the wafers being polished, and more specifically, the material being removed from the wafer surface. For instance, if a copper CMP operation is being performed, then the chemistry is selected such that copper byproducts, e.g., $Cu_xO_y$, can be easily removed from the surface of the polishing pad 102. If the operation is an oxide CMP, then the chemistry is selected such that oxide byproducts are more easily removed, scrubbed, or dislodged from the surface of the polishing pad. Accordingly, chemistry 117 can be a chemical, DI water, or a combination of fluids that can be optimally selected and injected into the brush system 130 to achieve the desired removal of byproducts from the surface of the polishing pad 102.

Figure 3:
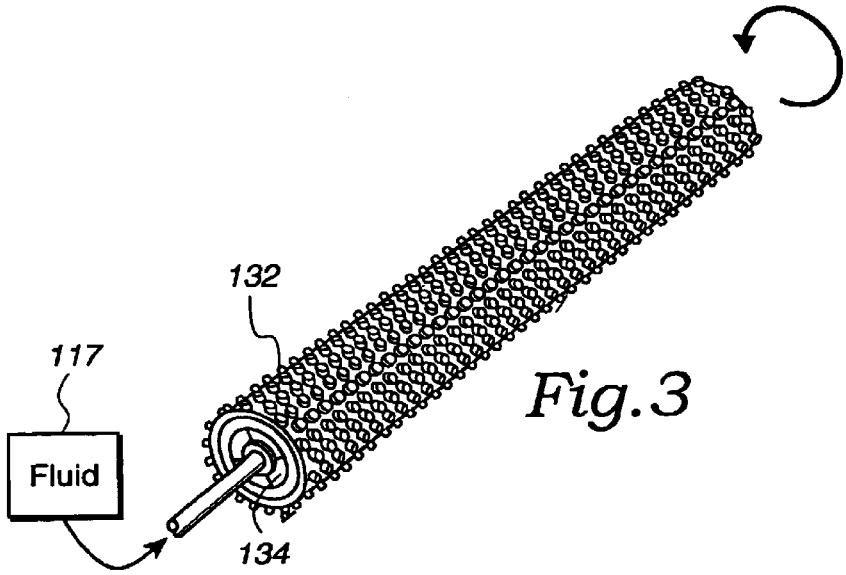
FIG. 3 is an enlarged perspective view of the exemplary brush shown in FIG. 2.

FIG. 3 illustrates a three-dimensional perspective view of a brush 132 mounted on a core 134. Chemistry 117 is injected into the core and is allowed to emanate into the spongy material of the brush 132, and thus, be distributed up against the surface of the polishing pad 102. PVA brushes are well suited for this application; however, it will be apparent to those skilled in the art that suitable brushes formed of different materials also may be used. In some instances, the brush material can be substituted with other materials that are coarser or allow improved agitation of the surface of the polishing pad 102.

Figure 4:
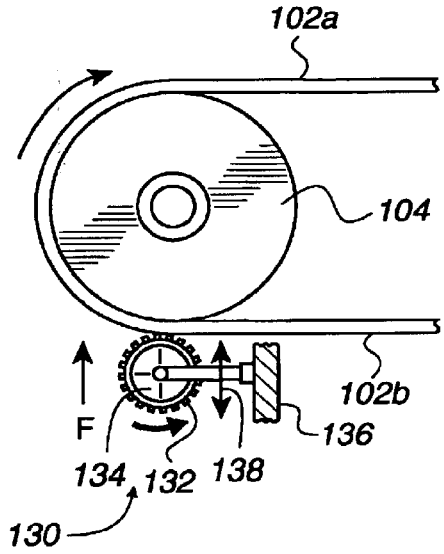
FIG. 4 is a simplified schematic diagram that illustrates how the brush can be adjustably mounted so that the force the brush applies against the polishing pad can be adjusted in accordance with one embodiment of the invention.

FIG. 4 is a simplified schematic diagram that illustrates how the brush can be adjustably mounted so that the force the brush applies against the polishing pad can be adjusted in accordance with one embodiment of the invention. As shown in FIG. 4, the brush system 130 can be adjusted so as to apply a different force, F, up against the surface of the polishing pad 102 in the bottom zone 102*b*. To increase the byproduct removal rate, the force, F, the brush system 130 applies against the polishing pad can be increased. However, the force, F, should not be increased to the point that particles of PVA (or other brush material) are left on the polishing pad. Preferably, the brush system 130 is applied in a region near the drum 104 so as to provide a relatively stable surface upon which to apply the desired level of force. Of course, the brush can be applied in regions other than under the drum 104, including on the top zone 102*a*. One advantage of brushing the polishing pad 102 in the bottom zone 102*b* is that the byproducts and any other particulates removed by the brushing action will naturally fall away from the top surface of the polishing pad due to gravity. For purposes of this example, the brush system 130 is connected to a wall 136 of the CMP system, and is allowed to mechanically move up and down, depending upon the force, F, applied to the polishing pad 102. It will be apparent to those skilled in the art that any suitable method of adjustably mounting the brush system may be used to implement the principles described herein.

Figure 5:
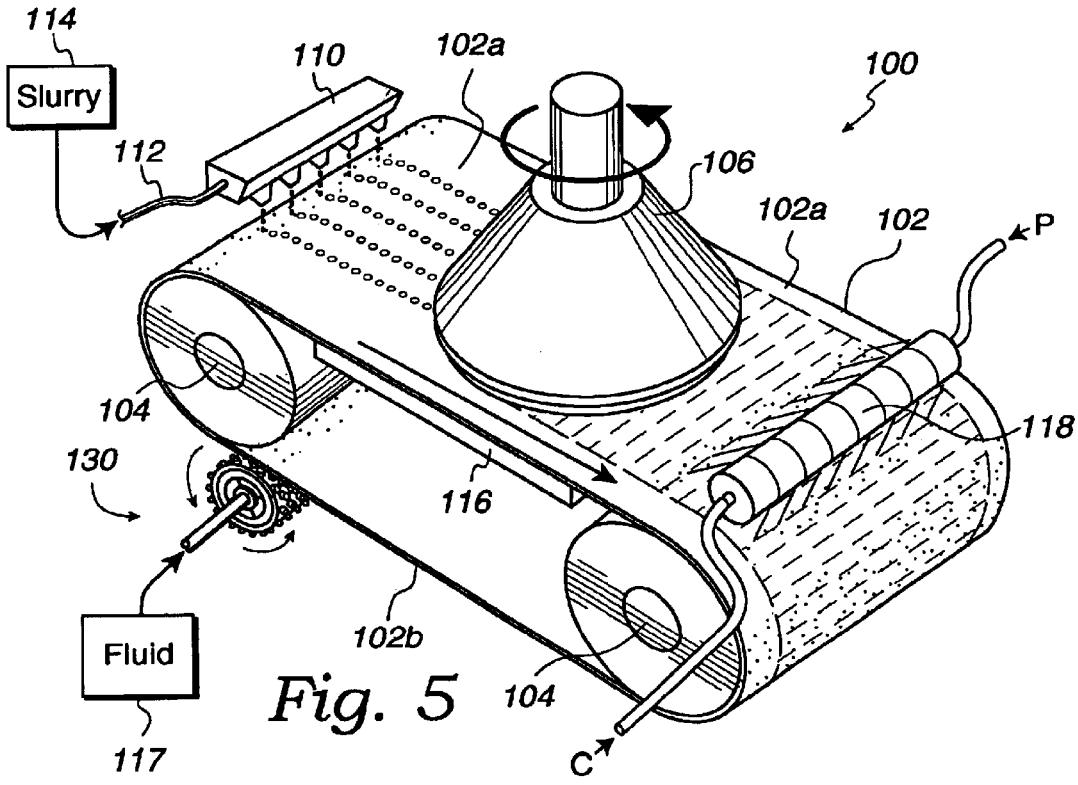
FIG. 5 is a simplified perspective view of a linear CMP system including a mixing manifold and a brush in accordance with one embodiment of the invention.

FIG. 5 is a simplified perspective view of a linear CMP system including a mixing manifold and a brush in accordance with one embodiment of the invention. As shown in FIG. 5, both the brush system 130 and the mixing manifold 118 are used in the same CMP system 100. In this embodiment, to achieve a more optimum level of surface preparation, the mixing manifold 118 applies a pressurized spray of chemistry onto the polishing pad 102 in the wafer track 103 and the brush system 130 brushes the polishing pad at bottom zone 102*b* thereof while applying chemistry to the surface of the polishing pad in the presence of the mechanical force being applied against the polishing pad by the brush. If desired, the positions of the mixing manifold 118 and the brush system 130 shown in FIG. 5 can be interchanged. In other words, the mixing manifold 118 can be configured to apply a spray of pressurized chemistry onto the polishing pad 102 at bottom zone 102*b* thereof and the brush system 130 can be configured to brush the polishing pad at top zone 102*a* thereof.

The mixing manifold and the brush system can be used alone or in combination, depending upon the level of agitation, cleanliness, scrubbing, or surface preparation desired for a particular polishing pad in view of the polishing operation being performed. The use of both the mixing manifold and the brush system is well suited for use in removing byproduct build-up that is difficult to remove using either the mixing manifold or the brush system alone, e.g., byproduct build-up on the sidewalls of the grooves in the polishing pad. As noted above, the removal of byproduct build-up on the sidewalls is important because such build-up can impede slurry transport across the polishing pad and introduce undesired removal rate (RR) variation across the wafer.

Figure 6:
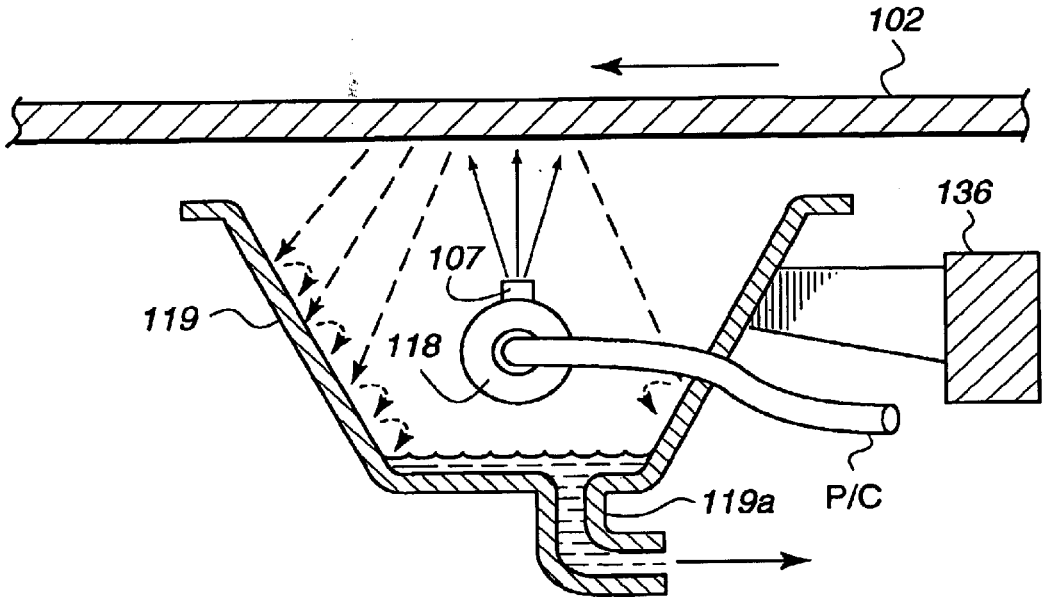
FIG. 6 is a simplified schematic diagram that shows the mixing manifold configured to apply a spray of pressurized chemistry to a surface of the polishing pad at a bottom zone thereof in accordance with one embodiment of the invention.

FIG. 6 is a simplified schematic diagram that shows mixing manifold 118 configured to apply a spray of pressurized chemistry to a surface of the polishing pad at a bottom zone thereof in accordance with one embodiment of the invention. As shown in FIG. 6, collection shield 119 surrounds mixing manifold 118 and is connected to a wall 136 of the CMP system. Collection shield 119 is configured to collect the back spray from the surface of polishing pad 102 and channel such back spray to drain 119*a*, which is coupled in flow communication with an appropriate waste receptacle. Collection shield 119 may have any suitable configuration, e.g., a partially conical configuration as shown in FIG. 6, and may be formed of any suitable material, e.g., PET. To enable mixing manifold 118 to be coupled in flow communication with sources of pressurized gas P and aqueous chemical solution C, holes may be provided in the collection shield 119 for the supply lines. If desired, seals may be provided to prevent the collected back spray from flowing through any gaps between supply lines and the holes. It will be apparent to those skilled in the art that collection shield 119 also may be used in conjunction with brush system 130 shown in, e.g., FIG. 2. In addition, when the brush system 130 is configured to brush polishing pad 102 at top zone 102*a* thereof, a suitable collection shield may be provided just below the appropriate drum 104 to collect the chemistry and particulates that fall from the polishing pad as the polishing pad rotates around the drum.

In the foregoing description, the principles of the invention have been described primarily in the context of byproduct removal associated with copper CMP. Those skilled in the art will recognize, however, that the principles described herein are also applicable to the removal of byproducts that are not specific to copper CMP. For example, in CMP processes that require a gentler polishing regime and therefore rely more heavily on chemical action to achieve planarity, relatively large amounts of surfactants and pad wetting agents are included in the slurry chemistries. These surfactants and pad wetting agents can come out of solution. When this happens, the surface of the polishing pad may absorb the surfactants or pad wetting agents. To avoid any adverse impact on the slurry transport across the wafer, the surface of the polishing pad should be kept clean of the residues created by the build-up of the surfactants or pad wetting agents. By way of example, suitable chemistries for removing such residues include relatively strong acids, e.g., $NHO_3$, relatively strong bases, e.g., KOH, and chemistries containing an oxidizing agent, e.g., $H_2O_2$.

In summary, the present invention provides a CMP system and a method for controlling byproduct build-up on a polishing pad in a CMP system. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A chemical mechanical planarization system, comprising:

a pair of drums, each of the pair of drums being configured to rotate;

a polishing pad disposed around the pair of drums;

a polishing head disposed above a top surface of the polishing pad, the polishing head being configured to hold a semiconductor wafer;

a slurry dispenser for dispensing a slurry onto the top surface of the polishing pad; and a mixing manifold having a plurality of outlets configured to direct a pressurized spray of a chemistry onto a top surface of the polishing pad, the plurality of outlets being configured to match a concentration gradient across a wafer track defined on the polishing pad, the mixing manifold being configured to be coupled in flow communication with a chemical source and a source of pressurized gas, and the mixing manifold being disposed on a side of the polishing head that is opposite of a side on which the slurry dispenser is disposed.

2. The chemical mechanical planarization system of claim 1, wherein the plurality of outlets is configured to direct the pressurized spray of the chemistry onto the top surface of the polishing pad at a top zone of the polishing pad.

3. A chemical mechanical planarization system, comprising:

a pair of drums, each of the pair of drums being configured to rotate;

a polishing pad disposed around the pair of drums;

a polishing head disposed above a top surface of the polishing pad, the polishing head being configured to hold a semiconductor wafer;

a slurry dispenser for dispensing a slurry onto the top surface of the polishing pad;

a mixing manifold having a plurality of outlets configured to direct a pressurized spray of a chemistry onto a top surface of the polishing pad, the mixing manifold being configured to be coupled in flow communication with a chemical source and a source of pressurized gas, and the mixing manifold being disposed on a side of the polishing head that is opposite of a side on which the slurry dispenser is disposed; and a shroud for collecting back spray from the top surface of the polishing pad and redirecting such back spray back onto the top surface of the polishing pad.

4. A chemical mechanical planarization system, comprising:

a pair of drums, each of the pair of drums being configured to rotate;

a polishing pad disposed around the pair of drums;

a polishing head disposed above a top surface of the polishing pad, the polishing head being configured to hold a semiconductor wafer;

a slurry dispenser for dispensing a slurry onto the top surface of the polishing pad;

a mixing manifold having a plurality of outlets configured to direct a pressurized spray of a chemistry onto a top surface of the polishing pad, the mixing manifold being configured to be coupled in flow communication with a chemical source and a source of pressurized gas, and the mixing manifold being disposed on a side of the polishing head that is opposite of a side on which the slurry dispenser is disposed; and a shroud for collecting back spray from the top surface of the polishing pad and redirecting such back spray back onto the top surface of the polishing pad, the shroud including a pair of deflector plates.

* * * * *